US012687306B2

(12) United States Patent
Liao

(10) Patent No.: US 12,687,306 B2
(45) Date of Patent: Jul. 21, 2026

(54) SPLIT-TYPE RANGE HOOD

(71) Applicant: BLUESKY COOKING STYLE CO., LTD., Taipei City (TW)

(72) Inventor: Chin-Jung Liao, Taipei City (TW)

(73) Assignee: BLUESKY COOKING STYLE CO., LTD., Taipei City (TW)

( * ) Notice: Subject to any disclaimer, the term of this patent is extended or adjusted under 35 U.S.C. 154(b) by 422 days.

(21) Appl. No.: 18/376,458

(22) Filed: Oct. 4, 2023

(65) Prior Publication Data

US 2024/0200789 A1 Jun. 20, 2024

(30) Foreign Application Priority Data

Dec. 19, 2022 (TW) ..... 111148643

(51) Int. Cl.
*F24C 15/20* (2006.01)

(52) U.S. Cl.
CPC ..... *F24C 15/2071* (2013.01); *F24C 15/2035* (2013.01)

(58) Field of Classification Search
CPC ... F24C 15/20; F24C 15/2035; F24C 15/2071
See application file for complete search history.

(56) References Cited

U.S. PATENT DOCUMENTS 3,889,581 A * 6/1975 Bray, Sr. ..... F16L 23/14 55/DIG. 36
4,266,528 A * 5/1981 Barnhart ..... F24C 15/20 126/299 D
4,738,244 A * 4/1988 Welsh ..... F24C 15/20 126/299 R
4,784,114 A * 11/1988 Muckler ..... F24C 15/20 126/299 R
6,499,482 B1 * 12/2002 Hung ..... F24C 15/20 126/299 R
10,041,687 B1 * 8/2018 Caneba ..... F24C 15/20
2020/0292178 A1 * 9/2020 Shahidinejad ..... F24C 15/2042
2021/0348799 A1 * 11/2021 Griffin ..... F24C 15/20
(Continued)

FOREIGN PATENT DOCUMENTS

TW 274361 U 4/1996
TW 335144 U 6/1998
TW M469449 U 1/2014
(Continued)

*Primary Examiner* — Ko-Wei Lin
(74) *Attorney, Agent, or Firm* — Li & Cai Intellectual Property (USA) Office

(57) ABSTRACT

The split-type range hood includes a range hood body, an exhaust motor, an air duct, a first duct sleeve, and a second duct sleeve. The range hood body includes a chassis and a smoke collecting box. The chassis has an air intake opening, the smoke collecting box is disposed on the chassis, and the smoke collecting box covers the air intake opening. The smoke collecting box has an air outlet opening, and the air outlet opening of the smoke collecting box is in fluid communication with the air intake opening of the chassis. A first flange is formed on a periphery of the air outlet opening of the smoke collecting box. The exhaust motor is disposed outside of the range hood body. The first duct sleeve is sleeved on the first flange, and the first duct sleeve is sleeved on one end of the air duct.

8 Claims, 6 Drawing Sheets

(56) References Cited

U.S. PATENT DOCUMENTS

2021/0381696 A1* 12/2021 Cimarra ..... F24C 15/2071

FOREIGN PATENT DOCUMENTS

| | | | |
|---|---|---|---|
| TW | M539027 | U | 4/2017 |
| TW | M606643 | U | 1/2021 |
| TW | M635153 | U | 12/2022 |
| TW | M639876 | U | 4/2023 |

* cited by examiner

SPLIT-TYPE RANGE HOOD

CROSS-REFERENCE TO RELATED PATENT APPLICATION

This application claims the benefit of priority to Taiwan Patent Application No. 111148643, filed on Dec. 19, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a split-type range hood, and more particularly to a split-type range hood having a split-type design for a range hood body and an exhaust motor.

BACKGROUND OF THE DISCLOSURE

A split-type range hood provides a split-type design for a range hood body and an exhaust motor, so that the exhaust motor can be located outdoors to minimize noises. The range hood body and the exhaust motor need to be connected through a duct, and a duct sleeve can be screwed to an outlet of the range hood body, and the duct sleeve is sleeved on one end of the duct, so that the one end of the duct can be connected to the air outlet of the range hood body through the duct sleeve. However, the duct sleeve is only fixed to the range hood body by screws, and a gap is easily formed between the duct sleeve and the range hood body, resulting in poor airtightness. When cooking fumes are conveyed from the air outlet of the range hood body to the duct, the cooking fumes can easily leak out from the gap, resulting in the cooking fumes being discharged at a lower efficiency. Furthermore, oil leakage can easily occur from the gap, resulting in the range hood body being contaminated.

SUMMARY OF THE DISCLOSURE

In response to the above-referenced technical inadequacies, the present disclosure provides a split-type range hood, in which a gap is not formed between a first duct sleeve and the range hood body. The split-type range hood has good airtightness, so that the cooking fumes do not leak out from the gap, resulting in a better efficiency in discharging of the cooking fumes. Moreover, oil leakage does not easily occur, thereby preventing the range hood body from being contaminated.

In order to solve the above-mentioned problems, one of the technical aspects adopted by the present disclosure is to provide a split-type range hood. The split-type range hood includes a range hood body, an exhaust motor, an air duct, a first duct sleeve, and a second duct sleeve. The range hood body includes a chassis and a smoke collecting box. The chassis has an air intake opening, the smoke collecting box is disposed on the chassis, and the smoke collecting box covers the air intake opening. The smoke collecting box has an air outlet opening, and the air outlet opening of the smoke collecting box is in fluid communication with the air intake opening of the chassis. A first flange is formed on a periphery of the air outlet opening of the smoke collecting box, the first flange is ring-shaped, and the first flange protrudes from the smoke collecting box. The exhaust motor is disposed outside of the range hood body. The exhaust motor includes a hull and a main motor, the hull has a first opening and a second opening, the main motor is disposed in the hull, and one end of the main motor has an exhaust outlet. A first duct sleeve is assembled and fixed on the smoke collecting box. The first duct sleeve is located outside of the air outlet opening, the first duct sleeve is sleeved on the first flange, and the first duct sleeve is sleeved on one end of the air duct, so that the one end of the air duct is in fluid communication with the air outlet opening of the range hood body through the first duct sleeve. A second duct sleeve is assembled and fixed on the hull. The second duct sleeve is located outside of the first opening, and the second duct sleeve is sleeved on another end of the air duct, so that the another end of the air duct is in fluid communication with the first opening of the exhaust motor through the second duct sleeve.

Therefore, the split-type range hood provided by the present disclosure includes a range hood body, an exhaust motor, an air duct, a first duct sleeve, and a second duct sleeve. A first flange is formed on a periphery of the air outlet opening of the smoke collecting box, and the first duct sleeve is sleeved on the first flange. In this way, the first duct sleeve and the smoke collecting box can be tightly fitted, and a gap is not formed between the first duct sleeve and the range hood body so that the first duct sleeve and the range hood body have a good airtightness. Furthermore, the cooking fume does not leak out from the gap, resulting in a better efficiency of discharging the cooking fume. Moreover, oil leakage does not easily occur, thereby preventing the range hood body from being contaminated.

Moreover, a second flange can be formed on a periphery of the first opening of the hull, and the second duct sleeve is sleeved on the second flange. In this way, the second duct sleeve and the hull of the exhaust motor can be tightly fitted, and a gap is not formed between the second duct sleeve and the exhaust motor so that the second duct sleeve and the exhaust motor have a good airtightness. Furthermore, the cooking fume does not leak out from the gap, resulting in better efficiency of discharging of the cooking fumes. Moreover, oil leakage does not easily occur, thereby preventing the exhaust motor from being contaminated.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
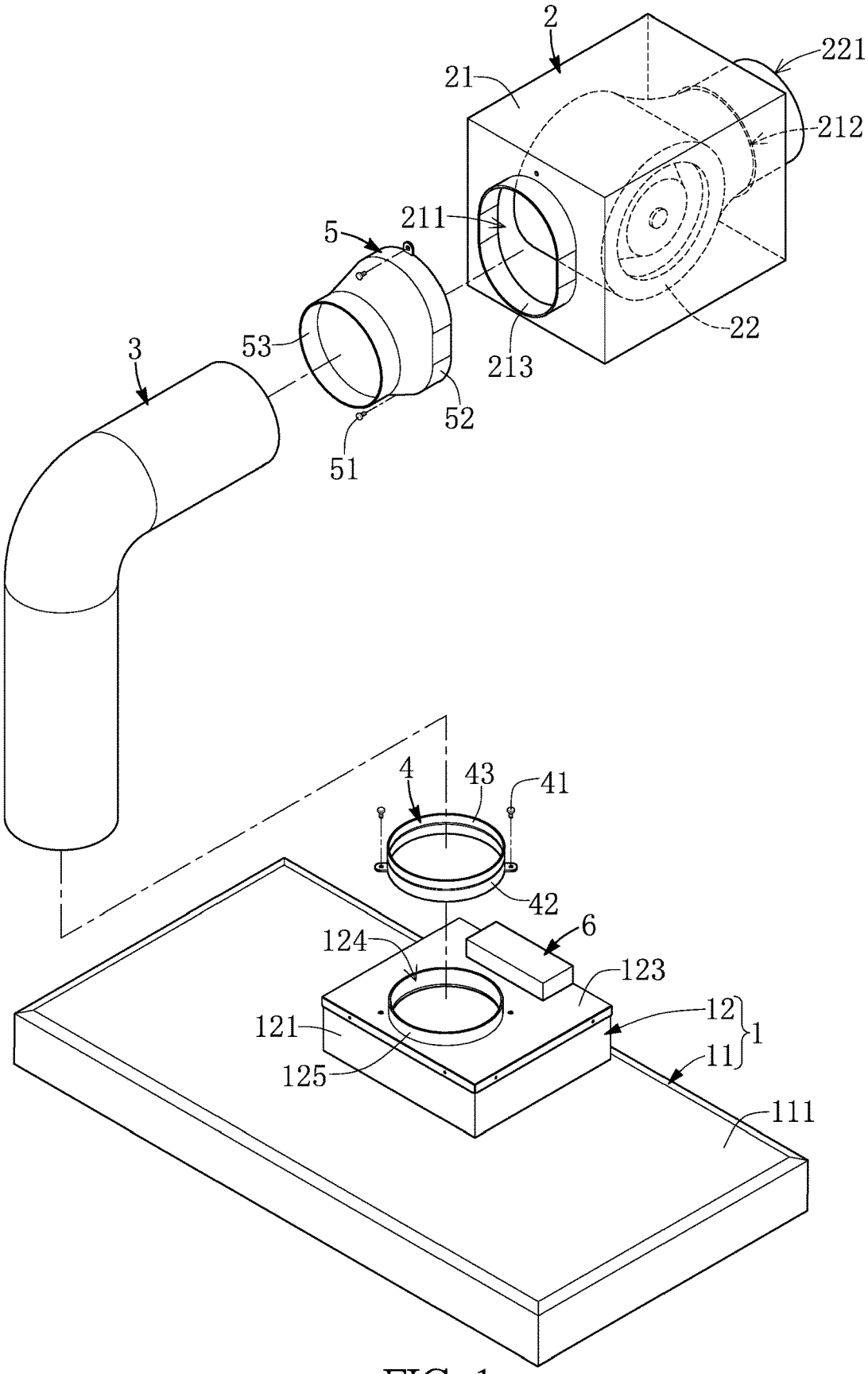
FIG. 1 is a schematic perspective exploded view of a split-type range hood according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

Embodiment

Figure 2:
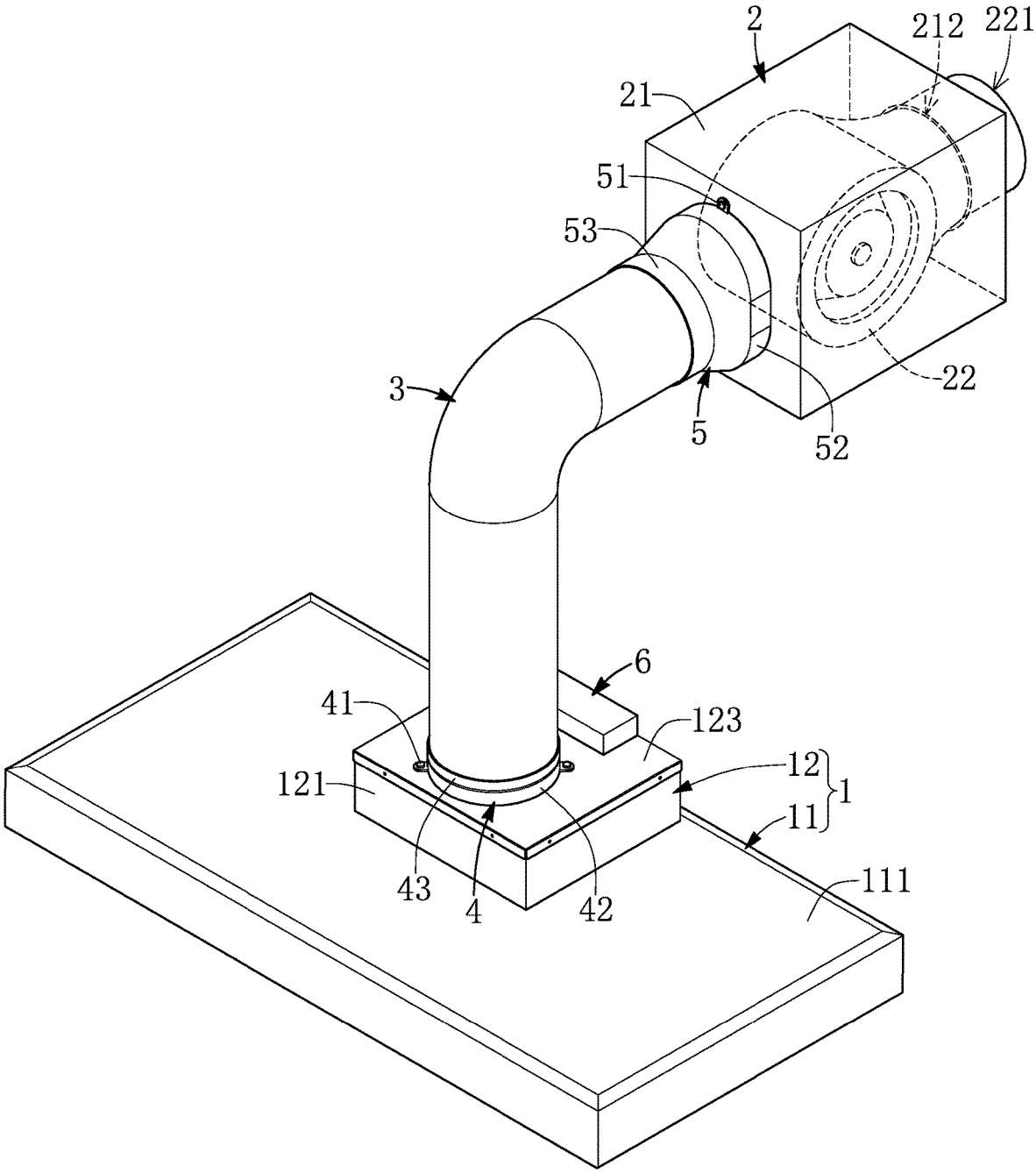
FIG. 2 is a schematic perspective view of the split-type range hood according to the present disclosure.
Figure 3:
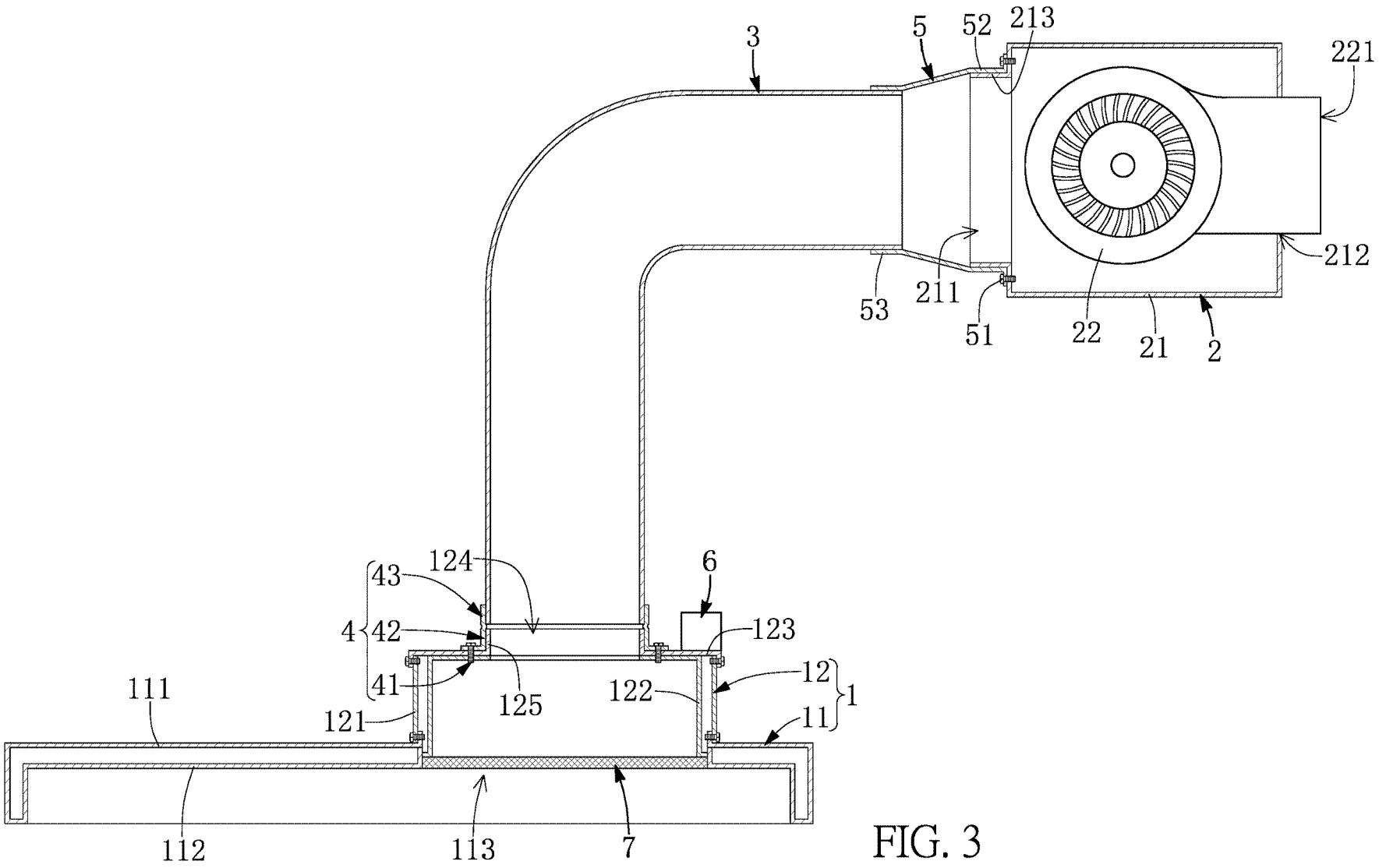
FIG. 3 is a schematic planar view of the split-type range hood according to the present disclosure.

Referring to FIG. 1 to FIG. 3, the present disclosure provides a split-type range hood. The split-type range hood includes a range hood body 1, an exhaust motor 2, an air duct 3, a first duct sleeve 4, and a second duct sleeve 5. The exhaust motor 2 is disposed outside of the range hood body 1, and the range hood body 1 is connected to the exhaust motor 2 through the first duct sleeve 4, the air duct 3, and the second duct sleeve 5, thereby allowing for the cooking fume to be ejected outward.

Figure 4:
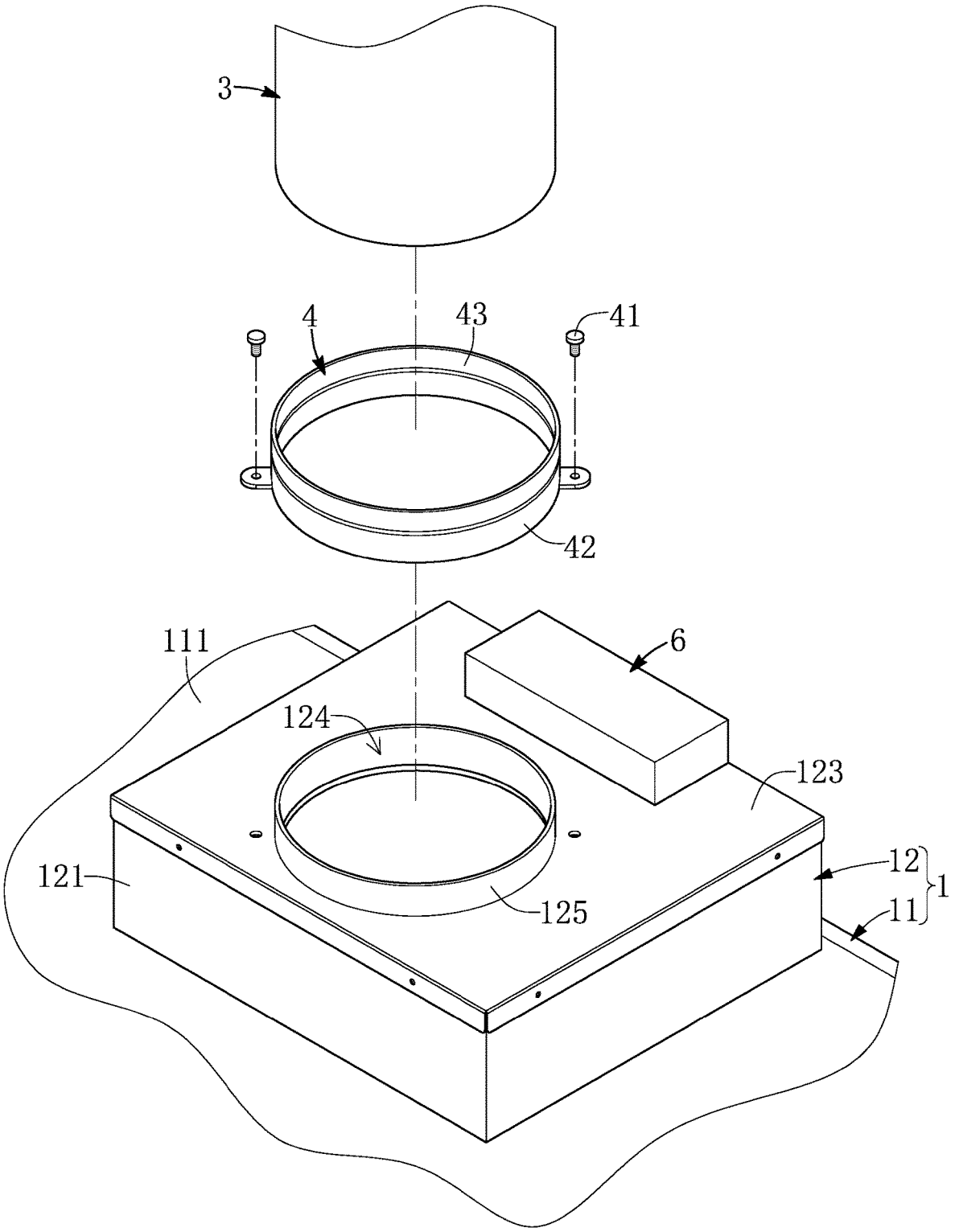
FIG. 4 is a schematic perspective exploded view of a range hood body, a first duct sleeve, and an air duct according to the present disclosure.
Figure 5:
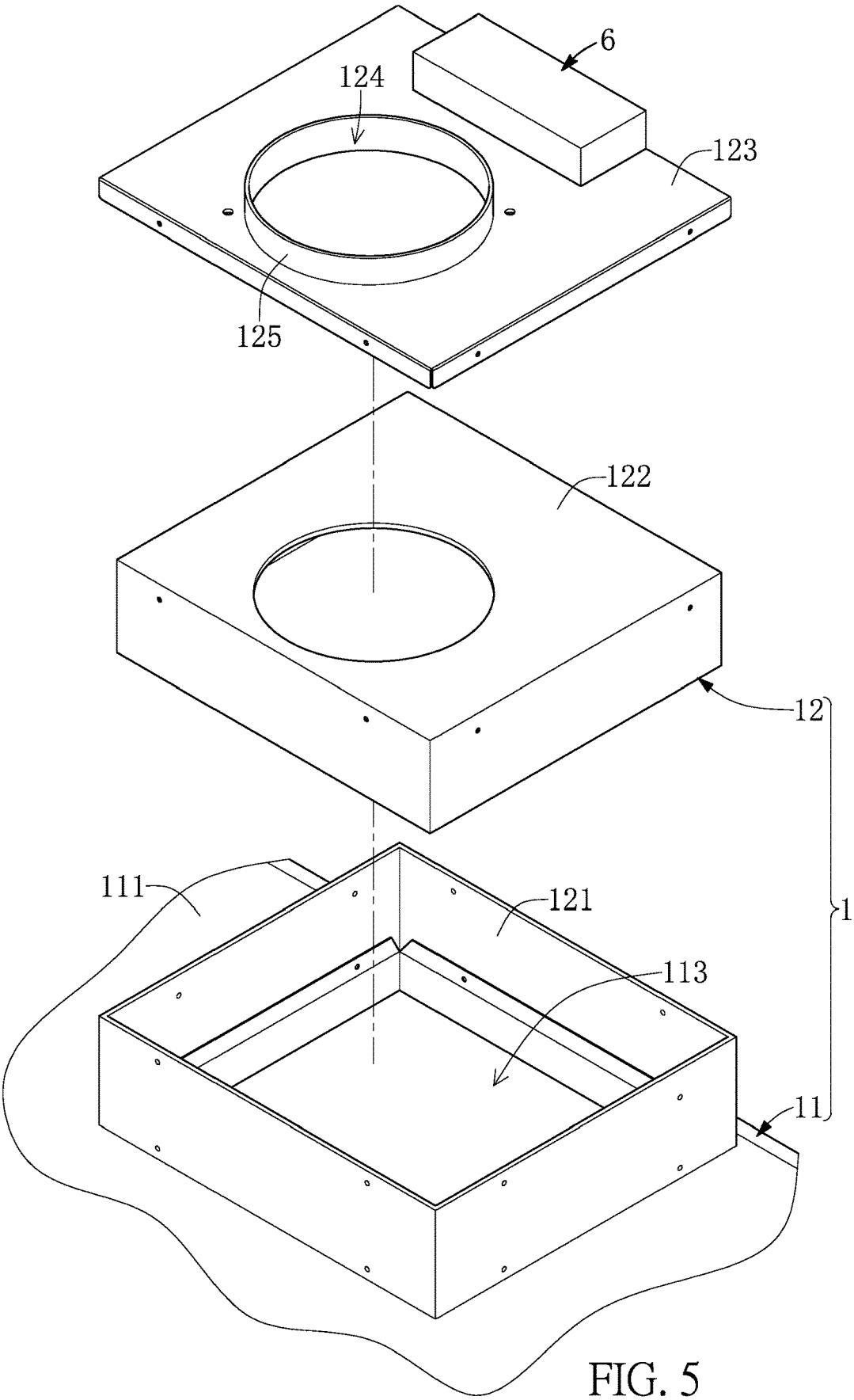
FIG. 5 is a schematic perspective exploded view of a smoke collecting box of the range hood body according to the present disclosure.

Referring to FIG. 4 and FIG. 5, the range hood body 1 includes a chassis 11 and a smoke collecting box 12. In this embodiment, the chassis 11 is substantially an inverted rectangular case, and a shape of the chassis 11 is not limited thereto. The chassis 11 can include a top wall 111 and a bottom wall 112, the bottom wall 112 is located below the top wall 111, and the top wall 111 can be parallel with the bottom wall 112. However, the present disclosure is not limited thereto. For example, the bottom wall 112 can be arranged to be inclined and disposed below the top wall 111 in an inclined manner. The chassis 11 has an air intake opening 113, and the air intake opening 113 penetrates the top wall 111 and the bottom wall 112. The air intake opening 113 is an air intake that allows cooking fumes to enter. In this embodiment, the air intake opening 113 is square-shaped, but a shape of the air intake opening 113 is not limited thereto.

The smoke collecting box 12 is disposed on the chassis 11, and the smoke collecting box 12 covers the air intake opening 113. The smoke collecting box 12 protrudes from the top wall 111, and a structure of the smoke collecting box 12 is not limited thereto. In this embodiment, the smoke collecting box 12 can include an outer box wall 121, a flow guiding body 122, and a covering board 123. The outer box wall 121 is fixed to a periphery of the air intake opening 113, and a portion near a bottom of the outer box wall 121 can be fixed to positions such as an upper edge of the air intake opening 113, or an inner side surface of the air intake opening 113 in manners such as riveting or threaded engagement, so that the outer box wall 121 can allow components to be fixed thereto. The flow guiding body 122 is disposed in the outer box wall 121, and the flow guiding body 122 can provide a smooth surface that improves a smoothness of the airflow and facilitates cleaning. The covering board 123 is fixedly connected to a top portion of the outer box wall 121 in manners such as threadedly locking or riveting. A top portion of the flow guiding body 122 can be fixedly connected to the covering board 123 by ways such as spot welding or riveting.

The smoke collecting box 12 has an air outlet opening 124. The air outlet opening 124 can be disposed on the covering board 123, and the air outlet opening 124 can be a circular opening. The air outlet opening 124 of the smoke collecting box 12 is in fluid communication with the air intake opening 113 of the chassis 11. In this embodiment, the smoke collecting box 12 is designed to have the flow guiding body 122 disposed in the outer box wall 121, so as to provide a more aesthetically pleasing appearance of an interior and a reduced turbulence of the cooking fume. After the cooking fume flows through the flow guiding body 122, the cooking fume can be more smoothly discharged from the air outlet opening 124 on the covering board 123.

A first flange 125 is formed on a periphery of the air outlet opening 124 of the smoke collecting box 12, the first flange 125 is ring-shaped, and in this embodiment, the first flange 125 is in a shape of a circular ring. The first flange 125 protrudes from the smoke collecting box 12 by an appropriate height that allows the first duct sleeve 4 to be sleeved on the first flange 125. The first flange 125 can be assembled to, or formed with the smoke collecting box 12 in one-piece. Preferably, the first flange 125 is formed with the smoke collecting box 12 in one-piece to have an improved airtightness. In this embodiment, the first flange 125 is formed on the covering board 123 of the smoke collecting box 12, and the first flange 125 can be formed in one-piece with the covering board 123 of the smoke collecting box 12.

The first duct sleeve 4 is assembled and fixed on the smoke collecting box 12 by being threadedly locked on the smoke collecting box 12 with at least two first screws 41. The first duct sleeve 4 is located outside of the air outlet opening 124, and the first duct sleeve 4 is sleeved on the first flange 125, so that the first duct sleeve 4 is tightly fitted with the smoke collecting box 12. Specifically, the first duct sleeve 4 can include a first connection portion 42 and a second connection portion 43. A shape of the first connection portion 42 corresponds with the first flange 125, and the first duct sleeve 4 is sleeved on the first flange 125 through the first connection portion 42. Because the first duct sleeve 4 can be a commercially available product, and a structure of the first duct sleeve 4 is not limited in the present disclosure, the first duct sleeve 4 will not be described in further detail herein.

The first duct sleeve 4 is sleeved on one end of the air duct 3, and the second connection portion 43 of the first duct sleeve 4 can be sleeved on the one end of the air duct 3. Therefore, the one end of the air duct 3 is in fluid communication with the air outlet opening 124 of the range hood body 1 through the first duct sleeve 4. Accordingly, the cooking fume can sequentially pass through the range hood body 1, the first duct sleeve 4, and the air duct 3 and be ejected outward.

The exhaust motor 2 includes a hull 21 and a main motor 22. The hull 21 has a hollow structure, and the hull 21 has a first opening 211 and a second opening 212. The first opening 211 and the second opening 212 can be formed on two opposite sides of the hull 21. The main motor 22 is disposed in the hull 21, and one end of the main motor 22 has an exhaust outlet 221. The exhaust outlet 221 corresponds with the second opening 212, so that the exhaust outlet 221 of the main motor 22 can also extend out from the hull 21 through the second opening 212, allowing the cooking fume suctioned by the exhaust motor 2 to be ejected outward.

A second flange 213 can be formed on a periphery of the first opening 211 of the hull 21, the second flange 213 is ring-shaped, and in this embodiment, the second flange 213 is in a shape of an ellipse ring. The second flange 213 protrudes from the hull 21 by an appropriate height that allows the second duct sleeve 5 to be sleeved on the second flange 213. The second flange 213 can be assembled to, or formed integrally with the hull 21 in a one-piece manner. Preferably, the second flange 213 is formed integrally with the hull 21 to have an improved airtightness.

Figure 6:
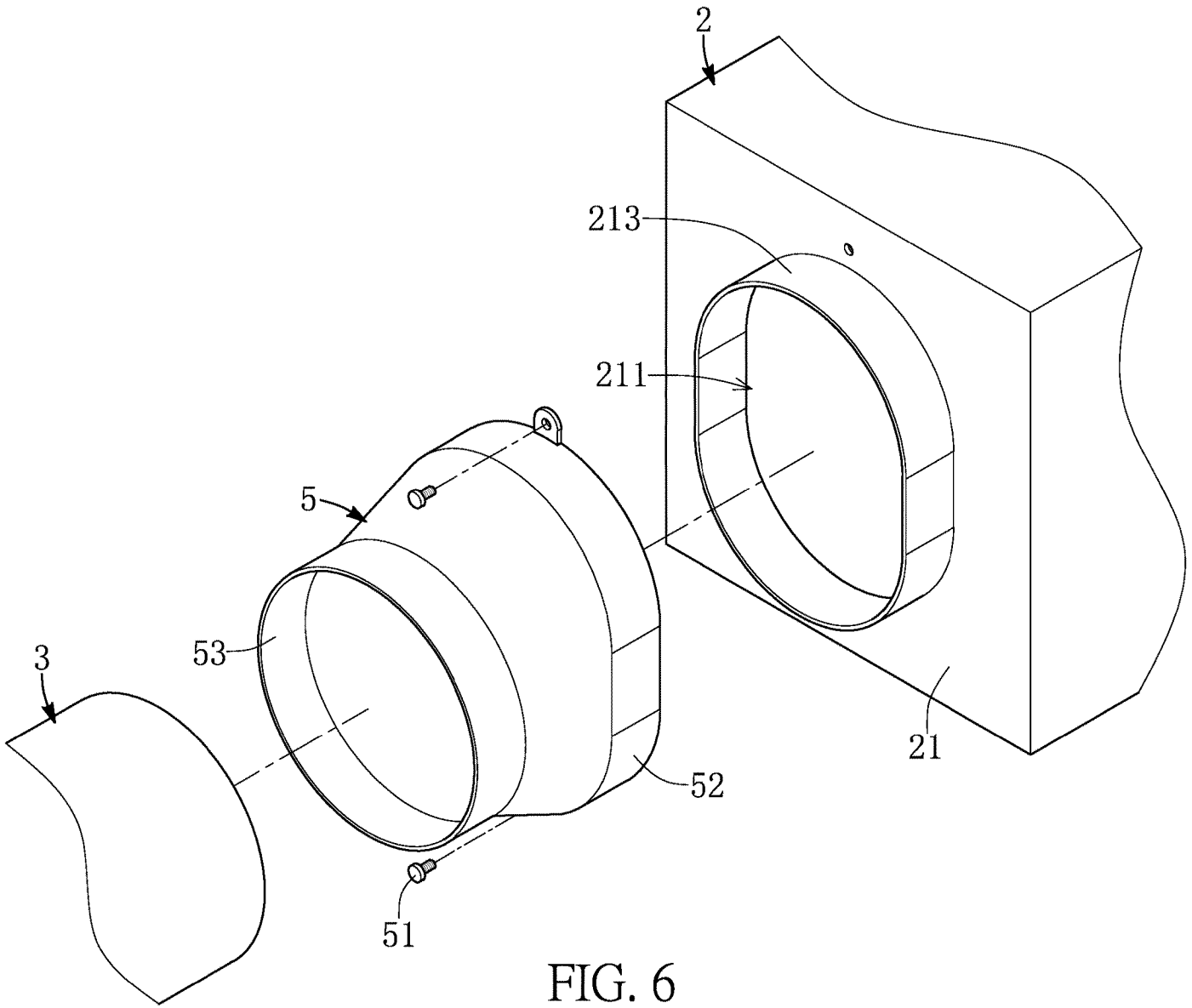
FIG. 6 is a schematic perspective exploded view of an exhaust motor, a second duct sleeve, and the air duct according to the present disclosure.

Referring further to FIG. 6, the second duct sleeve 5 is assembled and fixed on the hull 21 by manners such as using at least two second screws 51 to be threadedly locked on the hull 21. The second duct sleeve 5 is located outside of the first opening 211, and the second duct sleeve 5 is sleeved on the second flange 213, so that the second duct sleeve 5 is tightly fitted with the hull 21. Specifically, the second duct sleeve 5 can include a third connection portion 52 and a fourth connection portion 53. The second duct sleeve 5 is sleeved on the second flange 213 through the third connection portion 52. Because the second duct sleeve 5 can be a commercially available product, and a structure of the second duct sleeve 5 is not limited in the present disclosure, the second duct sleeve 5 will not be described in further detail herein.

The second duct sleeve 5 is sleeved on another end of the air duct 3, and the fourth connection portion 53 of the second duct sleeve 5 can be sleeved on the another end of the air duct 3, so that the another end of the air duct 3 can be in fluid communication with the first opening 211 of the exhaust motor 2 through the second duct sleeve 5. Accordingly, the range hood body 1 can be in fluid communication with the exhaust motor 2 sequentially through the first duct sleeve 4, the air duct 3, and the second duct sleeve 5, so as to eject the cooking fume outward.

In the present disclosure, the exhaust motor 2 is disposed outside of the smoke collecting box 12, thereby reducing an indoor noise and lowering a height of the smoke collecting box 12. Accordingly, an indoor mechanism (the range hood body 1) of a split-type range hood can have a greatly reduced height and a lowered weight, so as to facilitate mounting.

The split-type range hood of the present disclosure can further include a control box 6, and the control box 6 is disposed on a top portion of the covering board 123 of the smoke collecting box 12. Controlling circuitries (omitted in the figures) can pass through a space between the top wall 111 and the bottom wall 112 of the chassis 11, so that the circuitries can be hidden.

The split-type range hood of the present disclosure can further include a fume filter 7 disposed on the air intake opening 113. The fume filter 7 is located at a bottom of the smoke collecting box 12, so that the cooking fume can pass through the fume filter 7 to be filtered before entering the smoke collecting box 12.

Beneficial Effects of the Embodiment

In conclusion, the split-type range hood provided by the present disclosure includes a range hood body, an exhaust motor, an air duct, a first duct sleeve, and a second duct sleeve. A first flange is formed on a periphery of the air outlet opening of the smoke collecting box, and the first duct sleeve is sleeved on the first flange. In this way, the first duct sleeve and the smoke collecting box can be tightly fitted, and a gap is not formed between the first duct sleeve and the range hood body so that the first duct sleeve and the range hood body have a good airtightness. Furthermore, the cooking fume does not leak out from the gap, resulting in better efficiency of discharging of the cooking fume. Moreover, oil leakage does not easily occur, thereby preventing the range hood body from being contaminated.

Moreover, a second flange can be formed on a periphery of the first opening of the hull, and the second duct sleeve is sleeved on the second flange. In this way, the second duct sleeve and the hull of the exhaust motor can be tightly fitted, and a gap does not form between the second duct sleeve and the exhaust motor so that the second duct sleeve and the exhaust motor have a good airtightness. Furthermore, the cooking fume does not leak out from the gap, resulting in a better efficiency of discharging the cooking fume. Moreover, oil leakage does not easily occur, thereby preventing the exhaust motor from being contaminated.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A split-type range hood, comprising:

a range hood body including a chassis and a smoke collecting box, wherein the chassis has an air intake opening, the smoke collecting box is disposed on the chassis, and the smoke collecting box covers the air intake opening; wherein the smoke collecting box has an air outlet opening, and the air outlet opening of the smoke collecting box is in fluid communication with the air intake opening of the chassis; wherein a first flange is formed on a periphery of the air outlet opening of the smoke collecting box, the first flange is ring-shaped, and the first flange protrudes from the smoke collecting box;

an exhaust motor disposed outside of the range hood body, wherein the exhaust motor includes a hull and a main motor, the hull has a first opening and a second opening, the main motor is disposed in the hull, and one end of the main motor has an exhaust outlet;

an air duct;

a first duct sleeve assembled and fixed on the smoke collecting box, wherein the first duct sleeve is located outside of the air outlet opening, the first duct sleeve is sleeved on the first flange, and the first duct sleeve is sleeved on one end of the air duct, so that the one end of the air duct is in fluid communication with the air outlet opening of the range hood body through the first duct sleeve; and a second duct sleeve assembled and fixed on the hull, wherein the second duct sleeve is located outside of the first opening, and the second duct sleeve is sleeved on another end of the air duct, so that the another end of the air duct is in fluid communication with the first opening of the exhaust motor through the second duct sleeve.

2. The split-type range hood according to claim 1, wherein the chassis includes a top wall and a bottom wall, the bottom wall is located below the top wall, the air intake opening penetrates the top wall and the bottom wall, and the smoke collecting box protrudes from the top wall.

3. The split-type range hood according to claim 1, wherein the smoke collecting box includes an outer box wall, a flow guiding body, and a covering board; wherein the outer box wall is fixed to a periphery of the air intake opening, the flow guiding body is disposed in the outer box wall, and the covering board is fixedly connected to a top portion of the outer box wall.

4. The split-type range hood according to claim 3, wherein the air outlet opening and the first flange are formed on the covering board.

5. The split-type range hood according to claim 1, wherein the first flange is formed integrally in one piece with the smoke collecting box.

6. The split-type range hood according to claim 1, wherein the first duct sleeve is threadedly locked on the smoke collecting box by using at least two first screws.

7. The split-type range hood according to claim 1, wherein the second duct sleeve is threadedly locked on the hull by using at least two second screws.

8. The split-type range hood according to claim 1, further comprising: a fume filter disposed on the air intake opening, wherein the fume filter is located at a bottom of the smoke collecting box.

* * * * *